US006871366B2

(12) United States Patent
Cho

(10) Patent No.: US 6,871,366 B2
(45) Date of Patent: Mar. 29, 2005

(54) MATTRESS-INTEGRAL STONE BED

(76) Inventor: Mu-Hyun Cho, 255-11 Yangjae 2-dong, Seocho-gu, Seoul 137 132 (KR)

( * ) Notice: Subject to any disclaimer, the term of this patent is extended or adjusted under 35 U.S.C. 154(b) by 200 days.

(21) Appl. No.: 10/606,826

(22) Filed: Jun. 26, 2003

(65) Prior Publication Data

US 2004/0034930 A1 Feb. 26, 2004

(30) Foreign Application Priority Data

Jun. 26, 2002 (KR) ..... 10-2002-0036059
May 14, 2003 (KR) ..... 20-2003-0014863

(51) Int. Cl.[7] ..... A47C 21/04; A47C 19/00
(52) U.S. Cl. ..... 5/421; 5/200.1
(58) Field of Search ..... 5/421, 284, 200.1, 5/201, 282.1, 285; 219/217

(56) References Cited

U.S. PATENT DOCUMENTS 4,679,261 A * 7/1987 Stanley et al. ..... 5/183
4,734,946 A * 4/1988 Saputo ..... 5/400
4,901,383 A * 2/1990 Yang et al. ..... 5/201
5,146,633 A * 9/1992 Kim et al. ..... 5/421
5,241,959 A * 9/1993 Kim et al. ..... 607/104
5,257,428 A * 11/1993 Carroll et al. ..... 5/620
5,259,379 A * 11/1993 Kim et al. ..... 607/104
5,430,900 A * 7/1995 Kim ..... 5/421
5,438,723 A * 8/1995 Carroll ..... 5/620
5,444,878 A * 8/1995 Kang ..... 5/421
5,500,007 A * 3/1996 Kim et al. ..... 607/104
5,889,923 A * 3/1999 Lee et al. ..... 392/435
6,148,457 A * 11/2000 Sul ..... 5/421
6,216,289 B1 * 4/2001 Woods ..... 5/200.1

FOREIGN PATENT DOCUMENTS

FR 002584907 A1 * 1/1987 ..... 5/201
FR 002608420 * 6/1988 ..... 5/282.1
IT 000672945 * 10/1964 ..... 5/282.1

* cited by examiner

*Primary Examiner*—Robert G. Santos
(74) *Attorney, Agent, or Firm*—Jenkens & Gilchrist, P.C.

(57) ABSTRACT

A mattress-integral stone bed is disclosed. The constitution of the mattress-integral stone bed is simplified by eliminating the conventional supporting frame unit so as to curtail the manufacturing cost and so as to improve the economy. Further, its handling is rendered convenient owing to the simplified constitution, as well as making the moving of the stone bed easy when moving the residence. Further, the internal stacked elements of the mattress such as stone plate, supporting plate, electro-heating plate and fixed plate are secured in a form of a sealed firm structure, so that the stacked elements can be prevented from being detached, thereby protecting the stacked elements from damages when moving. The mattress-integral stone bed according to the present invention includes the following elements. That is, rectangularly bent engaging pieces are fastened with fastening means on an inside of an installation opening of the mattress body. A securing plate is coupled to a bottom of the mattress body with fastening means. A rectangular supporting frame is provided with a plurality of detachably assembling holes, the detachably assembling holes reaching the securing plate. A plurality of supporting legs are respectively fitted into the plurality of the detachably assembling holes.

5 Claims, 10 Drawing Sheets

"PRIOR ART"

MATTRESS-INTEGRAL STONE BED

FIELD OF THE INVENTION

The present invention relates to a mattress-integral stone bed. More specifically, the present invention relates to a mattress-integral stone bed in which the supporting frame unit is excluded from the general stone bed, and the mattress can be assembled and disassembled, thereby providing a simple bed.

BACKGROUND OF THE INVENTION

Generally, stone bed is a kind of bed which has been developed for those who are accustomed in the under-floor heating system. As shown in FIG. 1, this stone bed is constituted as follows.

That is, a supporting frame unit 10 forms the basic frame which is necessary for forming the entire bed, and on the upper face of the supporting frame unit 10, there are mounted auxiliary elements such as a fixed plate 20, an insulating plate 30, a supporting plate 40 and a stone plate 50, thereby forming a stacked mattress 60.

However, in this conventional stone bed, the supporting frame unit is a necessary basic constituent upon which the mattress is settled. As a result, the manufacturing cost increases due to the presence of the supporting frame unit, thereby aggravating the economy.

Further, if the stone bed is to be moved to change its position, the moving is very troublesome due to the large bulk and weight of the stone bed, and therefore, the handling problem becomes serious.

Meanwhile, in the above described conventional stone bed, the mattress elements such as the fixed plate, the electro-heating plate, the supporting plate and the stone plate are simply stacked without any securing means but resorting only to their gravities. Accordingly, during the handling of the stone bed, if the bed is set upside down or set vertically, then the mattress elements including the fixed plate, the electro-heating plate, the supporting plate and the stone plate depart from the supporting frame unit, with the result that the mattress elements are subjected to damages.

SUMMARY OF THE INVENTION

The present invention is intended to overcome the above described disadvantages of the conventional technique.

Therefore it is an object of the present invention to provide a mattress-integral stone bed in which the constitution is simplified by eliminating the supporting frame unit so as to curtail the manufacturing cost and so as to improve the economy, and its handling is rendered convenient owing to the simplified constitution, as well as making the moving of the stone bed easy when moving the residence.

It is another object of the present invention to provide a mattress-integral stone bed in which the internal stacked elements of the mattress such as stone plate, supporting plate, electro-heating plate and fixed plate are secured in a form of a sealed firm structure, so that the stacked elements can be prevented from being detached, thereby protecting the stacked elements from damages when moving.

In achieving the above objects, the mattress-integral stone bed according to the present invention includes: rectangularly bent engaging pieces fastened with fastening means on an inside of an installation opening of a mattress body; a securing plate coupled to a bottom of the mattress body with fastening means; and a rectangular supporting frame having a plurality of detachably assembling holes, the detachably assembling holes reaching the securing plate, and a plurality of supporting legs being respectively fitted into the plurality of the detachably assembling holes.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

Now the preferred embodiments of the mattress-integral stone bed according to the present invention will be described referring to the attached drawings.

Figure 1:
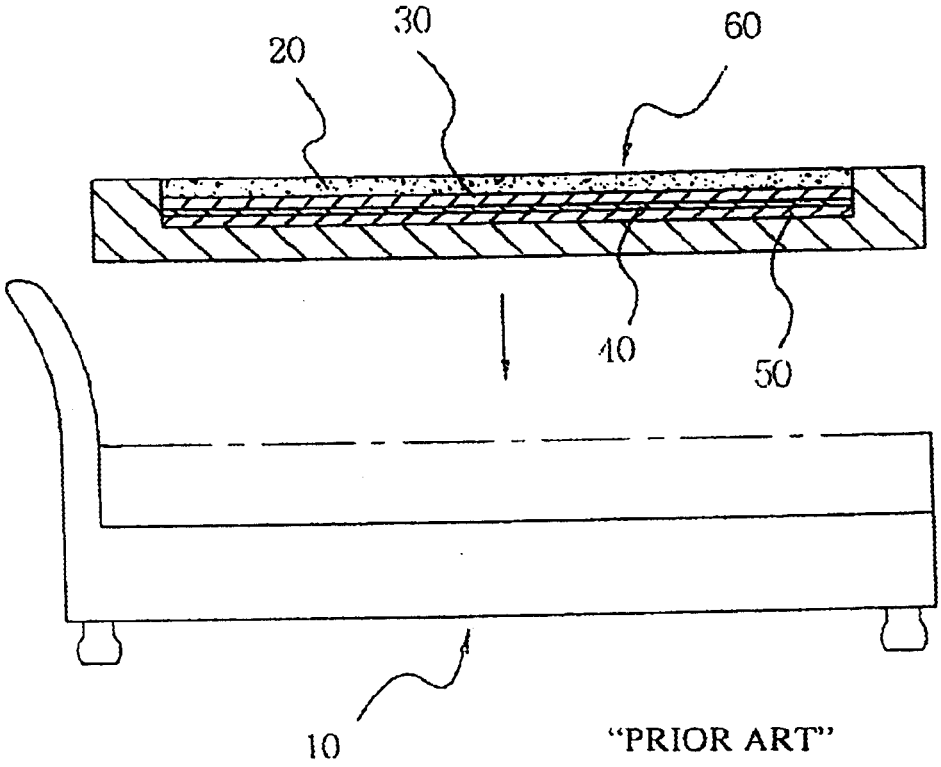
FIG. 1 illustrates the constitution of the conventional stone bed.
Figure 2:
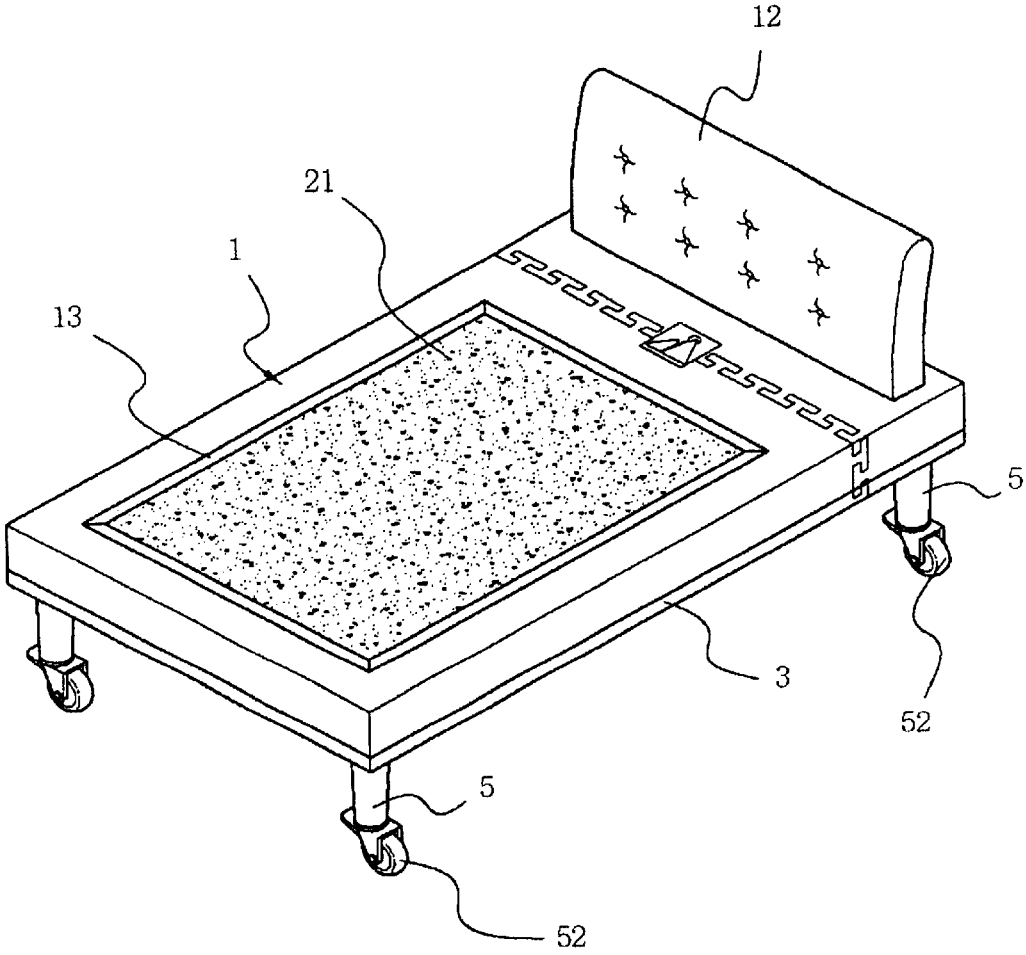
FIG. 2 is a perspective view of the mattress-integral stone bed according to the present invention.
Figure 3:
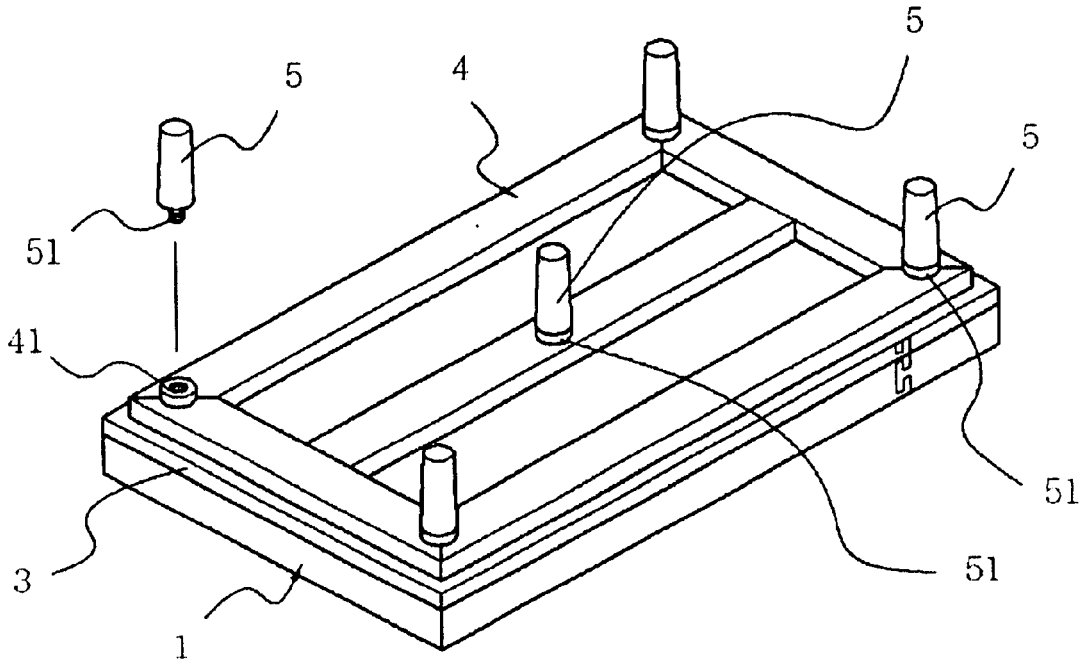
FIG. 3 is a perspective view showing the bottom of the stone bed according to the present invention.
Figure 4:
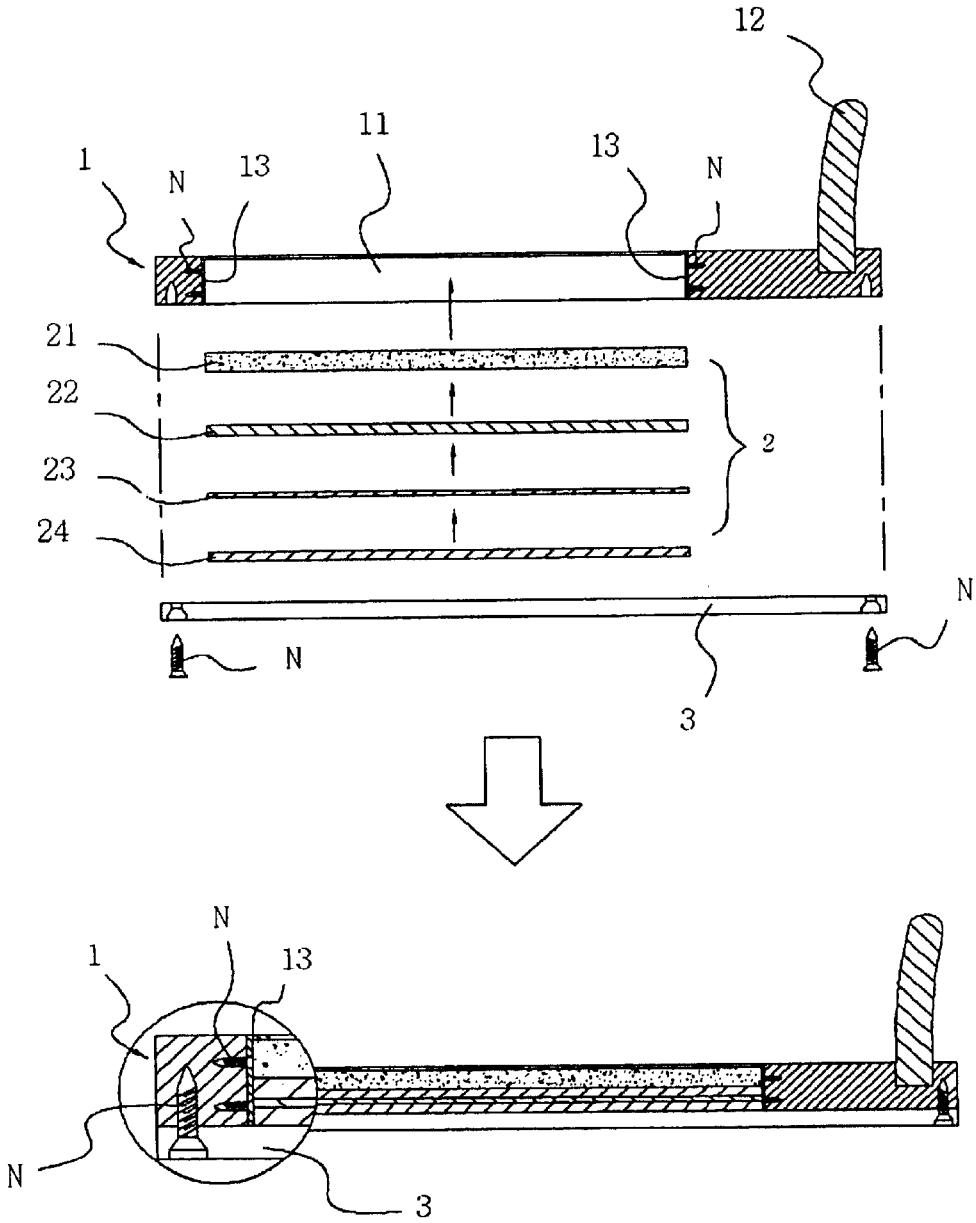
FIG. 4 is exploded and assembled sectional views of the mattress body of the stone bed according to the present invention.

FIG. 2 is a perspective view of the mattress-integral stone bed according to the present invention. FIG. 3 is a perspective view showing the bottom of the stone bed according to the present invention. FIG. 4 is exploded and assembled sectional views of the mattress body of the stone bed according to the present invention.

The mattress-integral stone bed according to the present invention includes: a mattress body 1, a stacked part 2, a securing plate 3, a supporting frame 4 and a plurality of supporting legs 5.

Here, the mattress body 1 is a rectangular plate with a predetermined thickness, and as shown in FIG. 4, a rectangular installation opening 11 is formed at the center of the mattress body 1, while a stopping plate 12 is formed in an upstanding form at one end of the mattress body 1. Particularly in this mattress body 1, preferably rectangularly bent engaging pieces 13 are secured on the inside walls of the installation opening 11 by using a fastening means N such as bolts and nuts.

Further, the stacked part 2 consists of a series of stacking elements which are installed within the installation opening 11 of the mattress body 1. As shown in FIG. 4, the stacked part 2 includes: a stone plate 21 for forming the surface of the mattress body 1; a supporting plate 22 installed under the stone plate 21, for serving a shock-absorbing role; an electro-heating plate 23 for carrying out an electrical heating; and a fixed plate 24 for serving a supporting role, the mentioned elements being stacked in the cited sequence.

Further, the securing plate 3 is a securing means for maintaining the coupled stacked elements of the stacked part 2 firmly in a sealed state. Preferably this securing plate 3 is a rectangular planar structure which is installed by using a fastening means N such as bolts and nuts.

Further, the supporting frame 4 is one of the essential features of the present invention, for supporting the mattress body 1 and the securing plate 3. This supporting frame 4 is preferably of a rectangular structure, having a plurality of detachably assembling holes 41 at its center and at the four corners of the supporting frame 4 respectively.

The supporting legs 5 are the usual supporting means, and are assembled into the detachably assembling holes 41 respectively. Each of these supporting legs 5 consists of a round post, and has a fastening thread part 51 as shown in FIG. 3 (here, the movable rollers are not illustrated)

As shown in FIG. 2, preferably a movable roller 52 is installed at the opposite end of each of the supporting legs 5, opposite from the fastening thread part 51, so that the stone bed can be conveniently moved.

Accordingly, the mattress-integral stone bed of the present invention constituted as described above is assembled in the following manner.

First, as shown in FIG. 4, into the installation opening 11 of the mattress body 1 in which the rectangularly bent engaging pieces 13 have been fastened, there are inserted and stacked the stone plate 21, the supporting plate 22, the electro-heating plate 23 and the fixed plate 24 in a sequential manner. This stacked part 2 consisting of the mentioned plates is prevented from being departed upward by the rectangularly bent engaging pieces 13. Further, the securing plate 3 is attached and fastened on the bottom of the stacked part 2 by using a fastening means N. Thus the stacked part 2 is accommodated within the installation opening 11 in a sealed form.

Under this condition, an adhesive can be spread on the respective layers of the stacked part 2 consisting of the stone plate 21, the supporting plate 22, the electro-heating plate 23 and the fixed plate 24, thereby reinforcing the coupling strength. This also should come within the scope of the present invention. Further, with the above described coupling form, the supporting frame 4 is unitizingly secured on the bottom of the securing plate 3. Then the plurality of the supporting legs 5 are assembled respectively into the detachably assembling holes 41, in such a manner that the supporting legs 5 can be assembled and disassembled to and from the detachably assembling holes 41 respectively, thereby completing the mattress-integral stone bed of the present invention.

Thus the mattress-integral stone bed in this embodiment has the following features. That is, with the simple supporting frame 4 and the supporting legs 5, the mattress body I itself forms a completed stone bed. Further, owing to the detachable feature of the supporting legs 5, the stone bed can be easily moved or transported in a convenient manner, while its bulk is reduced so as to make the handling of it also convenient.

Figure 5:
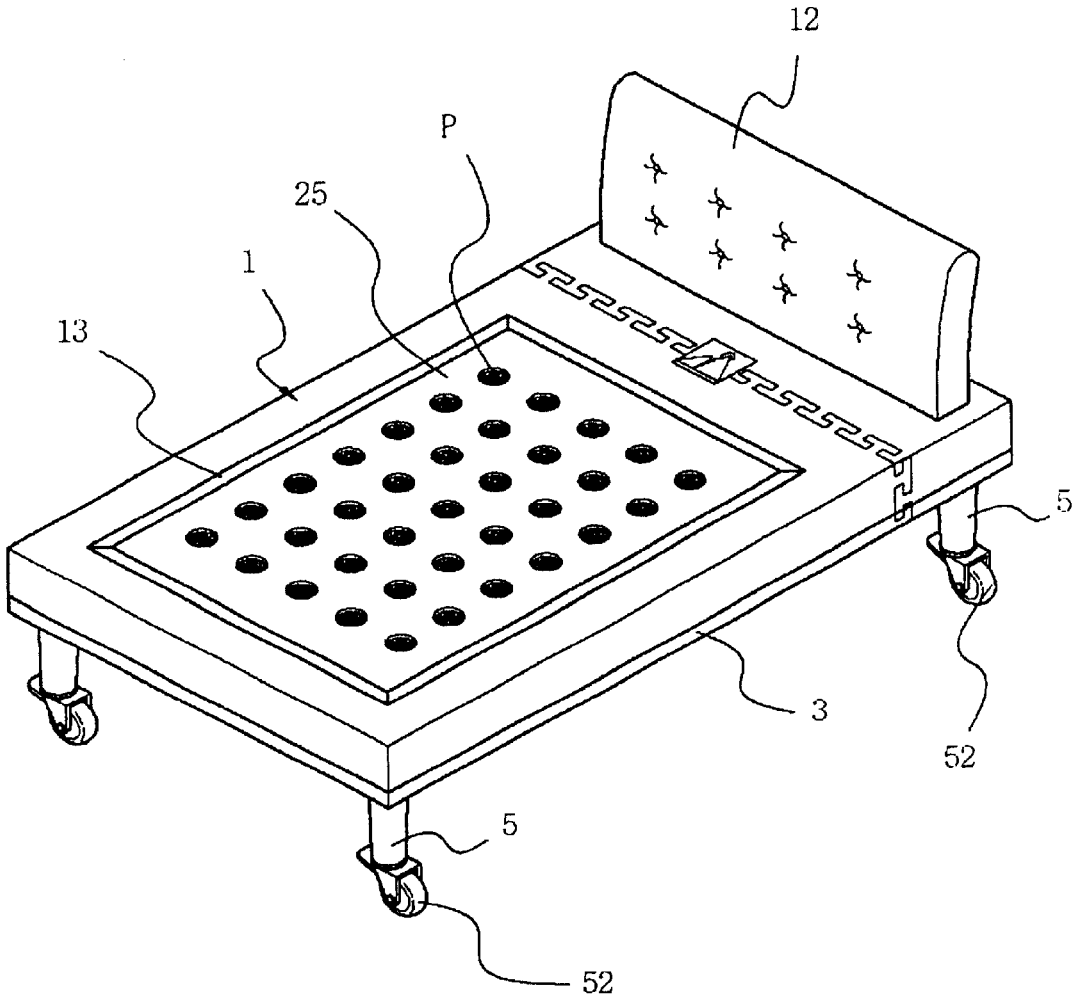
FIGS. 5 and 6 are perspective and sectional views showing another embodiment of the mattress-integral stone bed according to the present invention.
Figure 6:
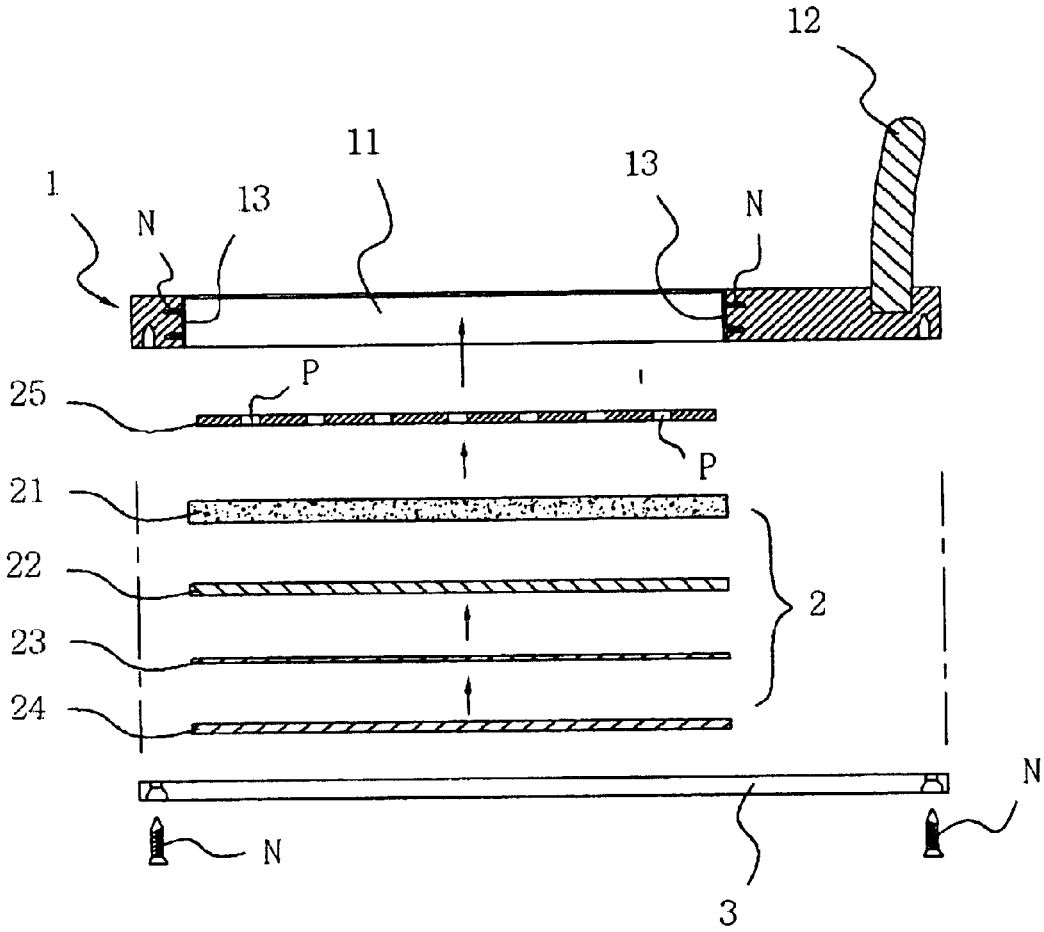

FIGS. 5 and 6 illustrate another embodiment of the mattress-integral stone bed according to the present invention. In this embodiment, the stone plate 21, the supporting plate 22, the electro-heating plate 23 and the fixed plate 24 are stacked into the installation opening 11 in the same manner. However, a cushion member 25 which has a plurality of heat-transferring holes P is additionally stacked upon the stone plate 21 as an option.

This second embodiment of the mattress-integral stone bed according to the present invention provides a cushion to the people who shun the stone plate 21 because of its hard property. However, the heat of the stone bed is well conducted through the heat-transferring holes P to the user. This also should come within the scope of the present invention.

Figure 7:
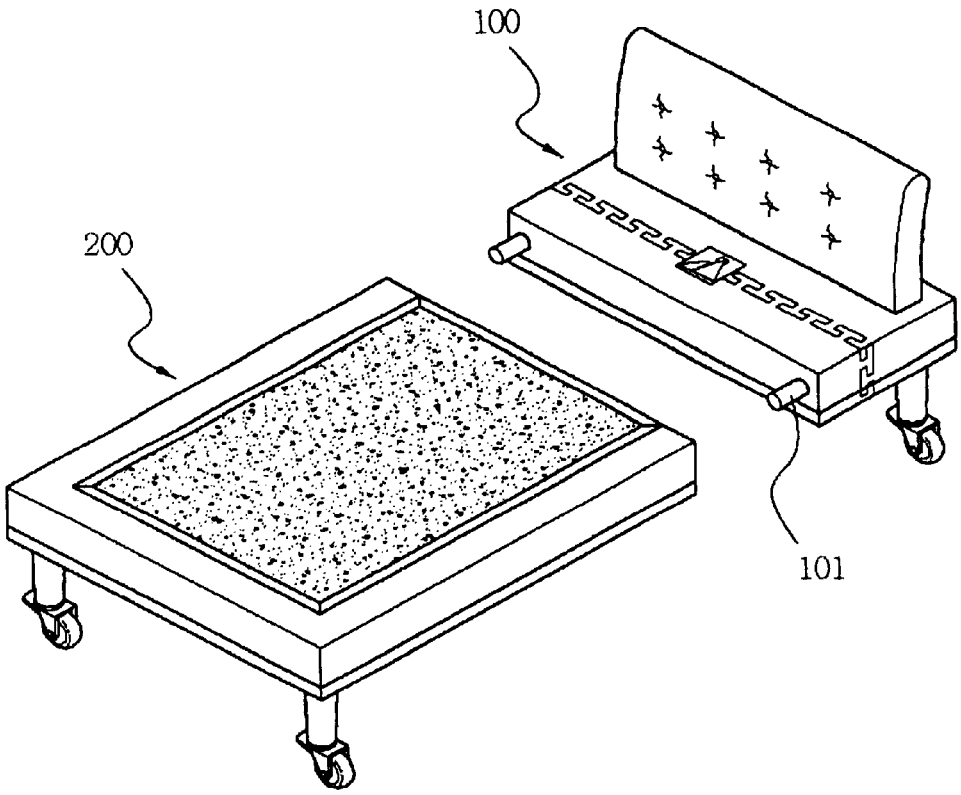
FIGS. 7 and 8 illustrate a third embodiment of the mattress-integral stone bed according to the present invention.
Figure 8:
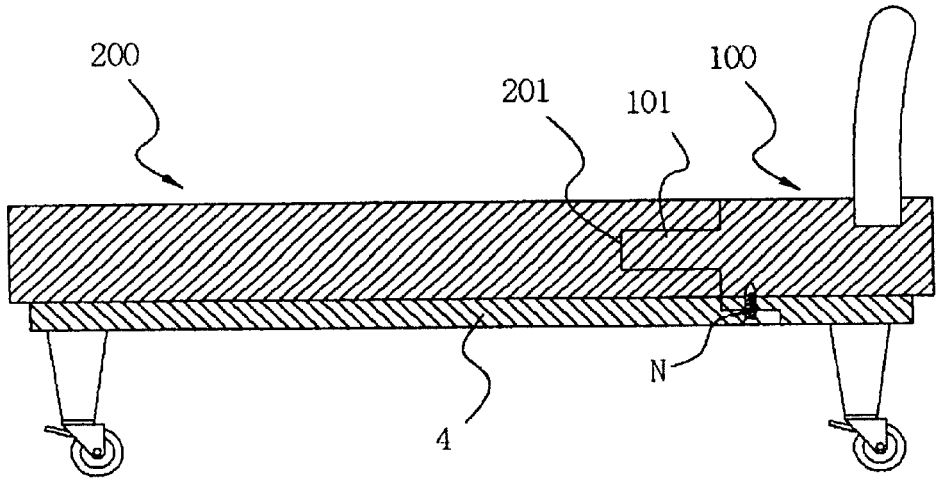

FIGS. 7 and 8 illustrate a third embodiment of the mattress-integral stone bed according to the present invention. In this third embodiment, the stone bed of FIG. 7 is laterally divided into two pieces (a first frame part 100 and a second frame part 200), and these two pieces are coupled together in accordance with the desire of the user.

For this purpose, the first frame part 100 is provided with a pair of coupling protuberances 101, while the second frame part 200 is provided with a pair of coupling holes 201. Thus in order to couple the first frame part 100 and the second frame part 200 together, the pair of the coupling protuberances 101 are mated into the coupling holes 201, thereby making it possible for the user to coupled the two frame parts 100 and 200 upon feeling a need.

In this third embodiment of the stone bed of the present invention in which the stone bed is divided into the first frame part 100 and the second frame part 200, there has also to be divided the supporting frame 4. For coupling the divided two parts of the supporting frame 4, the coupling portions of the supporting frame 4 have the forms of steps, and the two steps are coupled together, and fastened by using a fastening means N, thereby providing a firm securing strength.

Figure 9:
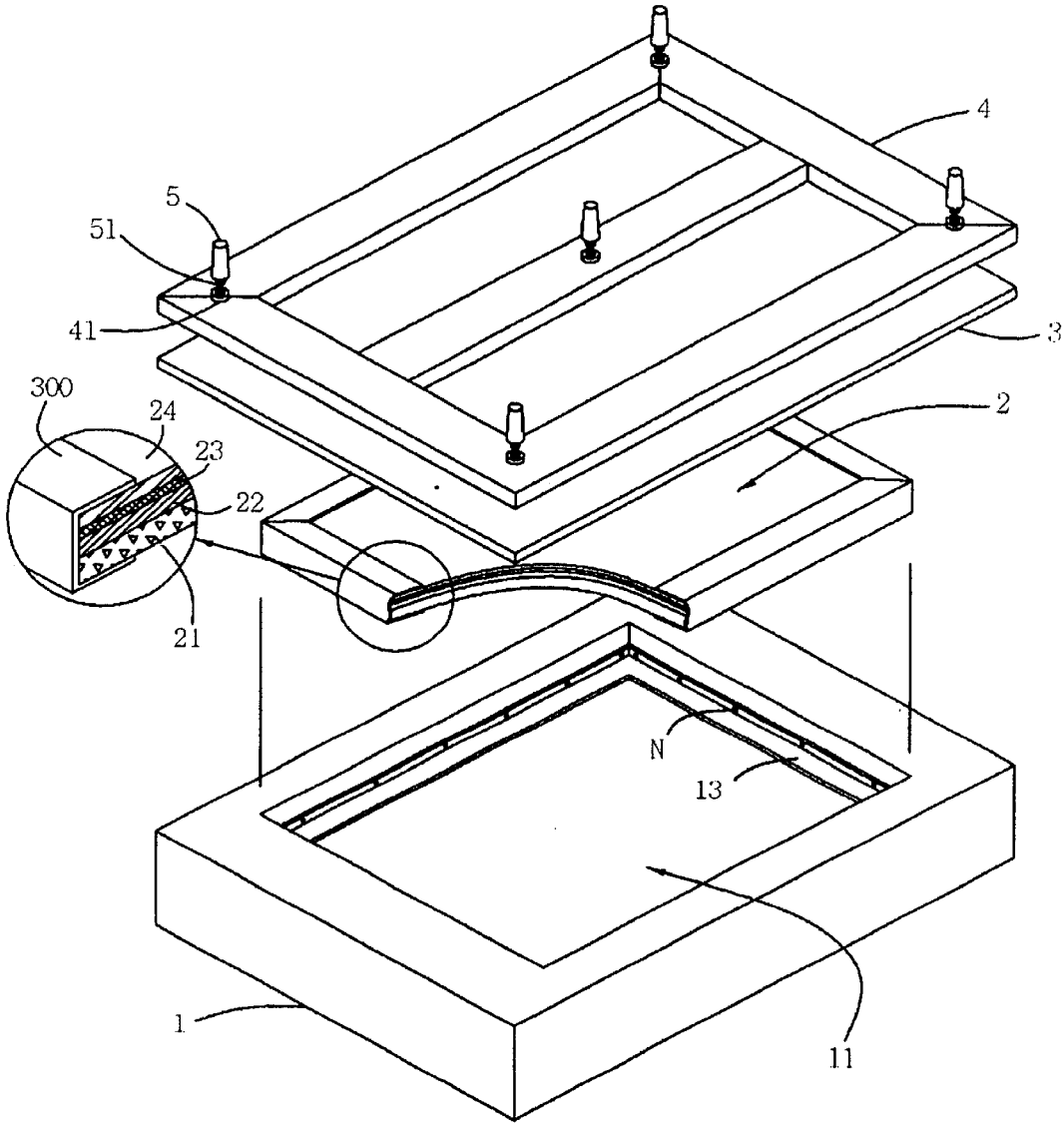
FIGS. 9 and 10 illustrate a forth embodiment of the mattress-integral stone bed according to the present invention.
Figure 10:
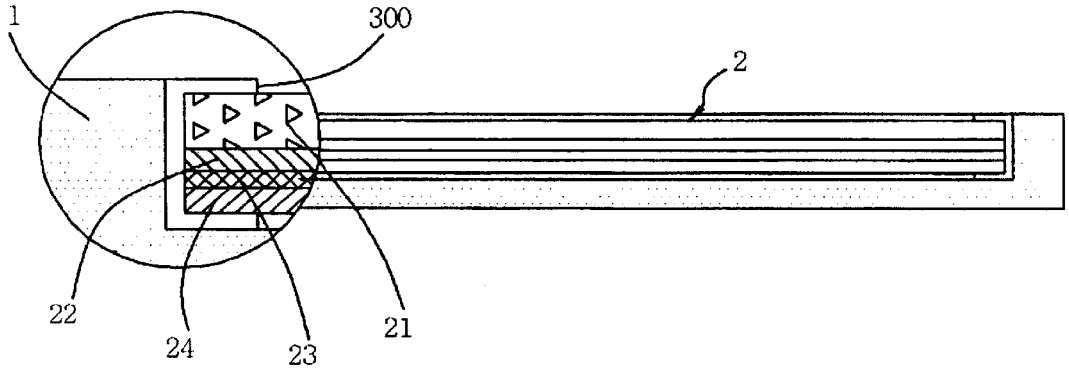

In a forth embodiment of the stone bed, as shown on FIGS. 9 and 10, a stone plate 21, a supporting plate 22, a heating plate 23 and a fastening plate 24 in a laminated part 2 being formed integrated by a ⊏" shaped metal fastener 300 and inserted in the opening 11.

As the elements in the laminated part 2 is integrated by the metal fastener 300, installation and transportation of the stone bed is more freely and a damage to the stone bed in can be prevented.

According to the present invention as described above, the conventional supporting frame unit is eliminated to simplify the stone bed and to form a mattress-integral stone bed. Further, the manufacturing cost is curtailed to improve the economy, and the handling of the stone bed is rendered convenient when moving or transporting the stone bed.

Further, the stacked part (consisting of the stone plate, the supporting plate, the electro-heating plate and the fixed plate) is firmly and sealingly secured with the rectangularly bent engaging pieces and the securing plate. Therefore, when handling or transporting the stone bed, the stacked elements of the stacked part are prevented from being detached, so that any damages of the stacked elements can be prevented.

What is claimed is:

1. A mattress-integral stone bed comprising:

rectangularly bent engaging pieces 13 fastened with fastening means N on an inside of an installation opening 11 of a mattress body 1;

a securing plate 3 coupled to a bottom of the mattress body 1 with fastening means N, for preventing any detachment of a stone plate 21, a supporting plate 22, an electro-heating plate 23 and a fixed plate 24 from the installation opening 11; and a rectangular supporting frame 4 having a plurality of detachably assembling holes 41, for being attached to a bottom of the securing plate 3, the detachably assembling holes 41 reaching the securing plate 3, and a plurality of supporting legs 5 detachably fitted into the plurality of the detachably assembling holes 41 respectively.2. The mattress-integral stone bed as claimed in claim 1, wherein a plurality of movable rollers 52 are respectively secured to the supporting legs 5 so as to make it convenient to move the stone bed.

3. The mattress-integral stone bed as claimed in claim 1, wherein a cushion member 25 with a plurality of heat-transferring holes P is additionally stacked upon the stone plate 21 so as to provide a cushioning feature.

4. The mattress-integral stone bed as claimed in claim 1, wherein the stone bed consisting of the mattress body 1, the securing plate 3, the supporting frame 4 and the supporting legs 5 is divided into a first frame part 100 and a second frame part 200, the first frame part 100 having a pair of coupling protuberances 101, and the second frame part 200 having a pair of coupling holes 201; and the supporting frame 4 is divided into two parts, the two parts being coupled through stepped portions, and the coupled stepped portions being fastened with a fastening means N.

5. A mattress-integral stone bed having an installation opening 1 passing through a mattress body 1, a rectangularly bent engaging pieces 13 fasten with a fastening means N on an inside of the opening 1, a laminated part 2 engaged with the pieces 13, a supporting frame 4 for fastening the laminated part 2 in the opening formed on the mattress body 1, and a supporting leg 5 detachably installed on a center part and edges of the supporting frame 4, the mattress-integral stone bed comprising, a stone plate 21, a supporting plate 22, a heating plate 23 and a fastening plate 24 in the laminated part 2 being integrated by a "⊏" shaped metal fastener 300 and inserted in the opening 11.

* * * * *

UNITED STATES PATENT AND TRADEMARK OFFICE

CERTIFICATE OF CORRECTION

PATENT NO. : 6,871,366 B2
DATED : March 29, 2005
INVENTOR(S) : Mu-Hyun Cho

It is certified that error appears in the above-identified patent and that said Letters Patent is hereby corrected as shown below:

Column 3,
Line 51, please replace the "I" after "body" with the number -- 1 --.

Signed and Sealed this

Eleventh Day of October , 2005

JON W. DUDAS
*Director of the United States Patent and Trademark Office*